US011777210B2

(12) United States Patent
Huang et al.

(10) Patent No.: US 11,777,210 B2
(45) Date of Patent: Oct. 3, 2023

(54) MOBILE DEVICE

(71) Applicant: Wistron Corp., New Taipei (TW)

(72) Inventors: Shih-Ting Huang, New Taipei (TW); Chia-Wei Su, New Taipei (TW); Po-Tsang Lin, New Taipei (TW)

(73) Assignee: WISTRON CORP., New Taipei (TW)

( * ) Notice: Subject to any disclaimer, the term of this patent is extended or adjusted under 35 U.S.C. 154(b) by 0 days.

(21) Appl. No.: 17/709,718

(22) Filed: Mar. 31, 2022

(65) Prior Publication Data

US 2023/0261378 A1 Aug. 17, 2023

(30) Foreign Application Priority Data

Feb. 15, 2022 (TW) ..... 111105393

(51) Int. Cl.

| | |
|---|---|
| ***H01Q 5/30*** | (2015.01) |
| ***H01Q 5/50*** | (2015.01) |
| ***H01Q 5/25*** | (2015.01) |
| ***H01Q 1/24*** | (2006.01) |

(Continued)

(52) U.S. Cl.

CPC ..... *H01Q 5/25* (2015.01); *H01Q 1/2283* (2013.01); *H01Q 1/241* (2013.01); *H01Q 5/30* (2015.01); *H01Q 5/50* (2015.01); *H01Q 21/061* (2013.01)

(58) Field of Classification Search

CPC ..... H01Q 1/24; H01Q 1/241; H01Q 1/243; H01Q 1/2283; H01Q 5/00; H01Q 5/30; H01Q 5/328; H01Q 5/357; H01Q 5/50; H01Q 21/061

See application file for complete search history.

(56) References Cited

U.S. PATENT DOCUMENTS

2009/0002243 A1* 1/2009 Dahlstrom ..... H01Q 21/30 343/702
2015/0022422 A1* 1/2015 Chang ..... H01Q 1/243 343/861

(Continued)

FOREIGN PATENT DOCUMENTS

TW I222769 B 10/2004
WO WO-2004097983 A1 * 11/2004 ..... H01Q 1/242

OTHER PUBLICATIONS

TW Office Action dated Jan. 10, 2023 in Taiwan application No. 111105393.

*Primary Examiner* — Thai Pham

(74) *Attorney, Agent, or Firm* — McClure, Qualey & Rodack, LLP

(57) ABSTRACT

A mobile device includes a ground element, a first radiation element, a second radiation element, and a dielectric substrate. The first radiation element has a feeding point. The first radiation element includes a meandering portion. The second radiation element is coupled to the feeding point, and is at least partially surrounded by the first radiation element. A coupling gap is formed between the first radiation element and the second radiation element. The ground element, the first radiation element, and the second radiation element are all disposed on the dielectric substrate. A planar antenna structure is formed by the first radiation element and the second radiation element. The planar antenna structure covers a TETRA (Terrestrial Trunked Radio) frequency band and a GPS (Global Positioning System) frequency band.

18 Claims, 4 Drawing Sheets

(51) Int. Cl.
*H01Q 21/06* (2006.01)
*H01Q 1/22* (2006.01)

(56) References Cited

U.S. PATENT DOCUMENTS

2015/0123874 A1* 5/2015 Chan ..... H01Q 5/30
343/905
2021/0328352 A1* 10/2021 Huang ..... H01Q 9/42

* cited by examiner

MOBILE DEVICE

CROSS REFERENCE TO RELATED APPLICATIONS

This application claims priority of Taiwan Patent Application No. 111105393 filed on Feb. 15, 2022, the entirety of which is incorporated by reference herein.

BACKGROUND OF THE INVENTION

Field of the Invention

The disclosure generally relates to a mobile device, and more particularly, it relates to a mobile device and an antenna structure therein.

Description of the Related Art

With the advancements being made in mobile communication technology, mobile devices such as portable computers, mobile phones, multimedia players, and other hybrid functional portable electronic devices have become more common. To satisfy user demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, 2500 MHz, and 2700 MHz. Some devices cover a small wireless communication area; these include mobile phones using Wi-Fi and Bluetooth systems and using frequency bands of 2.4 GHz, 5.2 GHz, and 5.8 GHz.

Antennas are indispensable elements for wireless communication. If an antenna used for signal reception and transmission has a narrow operational bandwidth, it will negatively affect the communication quality of the mobile device. Accordingly, it has become a critical challenge for designers to design a wideband antenna structure at a small size.

BRIEF SUMMARY OF THE INVENTION

In an exemplary embodiment, the disclosure is directed to a mobile device that includes a ground element, a first radiation element, a second radiation element, and a dielectric substrate. The first radiation element has a feeding point. The first radiation element includes a meandering portion. The second radiation element is coupled to the feeding point, and is at least partially surrounded by the first radiation element. A coupling gap is formed between the first radiation element and the second radiation element. The ground element, the first radiation element, and the second radiation element are all disposed on the dielectric substrate. A planar antenna structure is formed by the first radiation element and the second radiation element. The planar antenna structure covers a TETRA (Terrestrial Trunked Radio) frequency band and a GPS (Global Positioning System) frequency band.

In some embodiments, the mobile device further includes a signal source. The signal source has a positive electrode coupled to the feeding point, and a negative electrode coupled to a grounding point on the ground element.

In some embodiments, the TETRA frequency band is from 380 MHz to 430 MHz.

In some embodiments, the GPS frequency band is around 1575 MHz.

In some embodiments, the first radiation element substantially has an inverted U-shape.

In some embodiments, the meandering portion of the first radiation element substantially has an inverted M-shape.

In some embodiments, the first radiation element further includes a terminal extension portion.

In some embodiments, the second radiation element substantially has a variable-width straight-line shape.

In some embodiments, the second radiation element includes a narrow portion and a wide portion, and the wide portion is coupled through the narrow portion to the feeding point.

In some embodiments, a coupling gap is formed between the terminal extension portion of the first radiation element and the wide portion of the second radiation element.

In some embodiments, the width of the narrow portion of the second radiation element is from 1 mm to 2 mm.

In some embodiments, the width of the wide portion of the second radiation element is from 3 mm to 4 mm.

In some embodiments, the length of the first radiation element is shorter than 0.25 wavelength of the TETRA frequency band.

In some embodiments, the length of the first radiation element is substantially equal to 0.22 wavelength of the TETRA frequency band.

In some embodiments, the length of the meandering portion of the first radiation element is from 0.04 to 0.05 wavelength of the TETRA frequency band.

In some embodiments, the length of the second radiation element is shorter than 0.25 wavelength of the GPS frequency band.

In some embodiments, the length of the second radiation element is substantially equal to 0.15 wavelength of the GPS frequency band.

In some embodiments, the width of the coupling gap is from 3 mm to 4 mm.

In some embodiments, the meandering portion of the first radiation element defines a first notch and a second notch.

In some embodiments, the width of each of the first notch and the second notch is from 2 mm to 4 mm.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

Figure 1A:
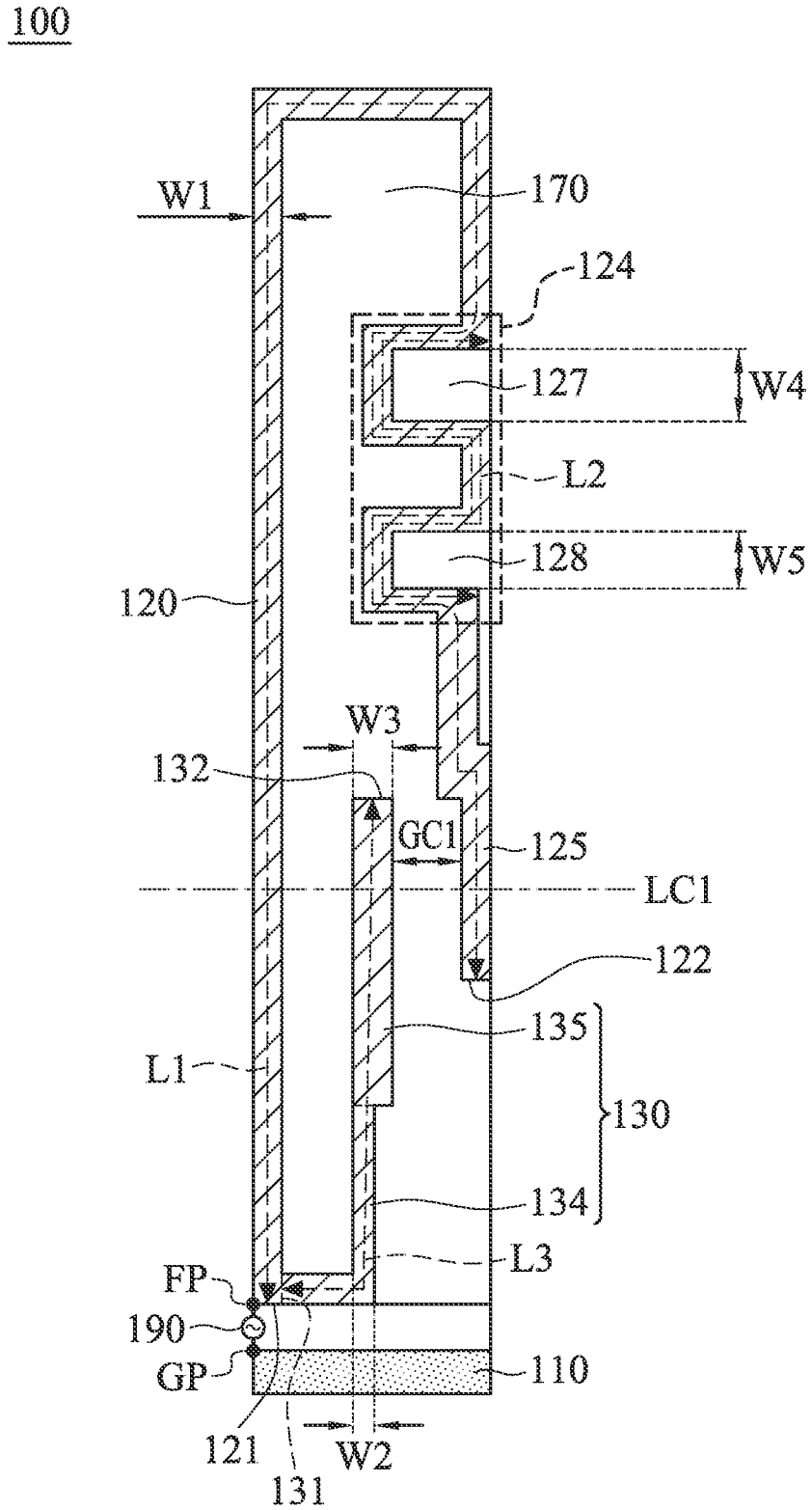
FIG. 1A is a top view of a mobile device according to an embodiment of the invention.

In order to illustrate the purposes, features and advantages of the invention, the embodiments and figures of the invention are shown in detail below.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Furthermore, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

Figure 1B:
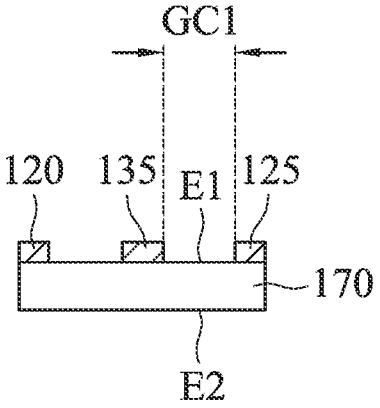
FIG. 1B is a sectional view of a mobile device according to an embodiment of the invention.

FIG. 1A is a top view of a mobile device 100 according to an embodiment of the invention. FIG. 1B is a sectional view of the mobile device 100 according to an embodiment of the invention (along a sectional line LC1 of FIG. 1A). Please refer to FIG. 1A and FIG. 1B together. For example, the mobile device 100 may be a wearable device, a smart phone, a tablet computer, or a notebook computer. Alternatively, the mobile device 100 may be any unit operating within the Internet of Things (JOT). It should be understood that the mobile device 100 may further include other components, such as a processor, a touch control panel, a speaker, and a housing, although they are not shown in FIG. 1A and FIG. 1B.

As shown in FIG. 1A and FIG. 1B, the mobile device 100 at least includes a ground element 110, a first radiation element 120, a second radiation element 130, and a dielectric substrate 170. The ground element 110, the first radiation element 120, and the second radiation element 130 may all be made of metal materials, such as copper, silver, aluminum, iron, or their alloys.

The ground element 110 may substantially have a rectangular shape. For example, the ground element 110 can provide a ground voltage. In some embodiments, the ground element 110 is further coupled to a system ground plane (not shown) of the mobile device 100.

The first radiation element 120 may substantially have an inverted U-shape. Specifically, the first radiation element 120 has a first end 121 and a second end 122. A feeding point FP is positioned at the first end 121 of the first radiation element 120. The second end 122 of the first radiation element 120 is an open end. The first radiation element 120 includes a meandering portion 124. For example, the meandering portion 124 of the first radiation element 120 may substantially have an inverted M-shape. The meandering portion 124 of the first radiation element 120 can define a first notch 127 and a second notch 128 which are separate from each other. The first notch 127 may substantially have a rectangular shape. The second notch 128 may substantially have another rectangular shape or an L-shape. In some embodiments, the first radiation element 120 further includes a terminal extension portion 125, which may substantially have a straight-line shape adjacent to the second end 122 of the first radiation element 120. It should be noted that the term "adjacent" or "close" over the disclosure means that the distance (spacing) between two corresponding elements is shorter than a predetermined distance (e.g., 10 mm or shorter), or means that the two corresponding elements are touching each other directly (i.e., the aforementioned distance/spacing therebetween is reduced to 0).

In some embodiments, the mobile device 100 further includes a signal source 190. The signal source 190 may be an RF (Radio Frequency) module, for example. Specifically, the signal source 190 has a positive electrode coupled to the feeding point FP, and a negative electrode coupled to a grounding point GP on the ground element 110. For example, the grounding point GP may be positioned at any corner of the ground element 110. In some embodiments, the signal source 190 is coupled through a coaxial cable (not shown) to the first radiation element 120 and the ground element 110.

The second radiation element 130 may substantially have a variable-width straight-line shape. Specifically, the second radiation element 130 has a first end 131 and a second end 132. The first end 131 of the second radiation element 130 is coupled to the feeding point FP. The second end 132 of the second radiation element 130 is an open end. For example, the second end 122 of the first radiation element 120 and the second end 132 of the second radiation element 130 may substantially extend in opposite directions. It should be noted that the second radiation element 130 is at least partially surrounded by the first radiation element 120. In some embodiments, the second radiation element 130 includes a narrow portion 134 adjacent to the first end 131 and a wide portion 135 adjacent to the second end 132. The wide portion 135 is coupled through the narrow portion 134 to the feeding point FP. For example, the narrow portion 134 of the second radiation element 130 may substantially have an L-shape, and the wide portion 135 of the second radiation element 130 may substantially have a straight-line shape. In some embodiments, a coupling gap GC1 is formed between the terminal extension portion 125 of the first radiation element 120 and the wide portion 135 of the second radiation element 130.

The dielectric substrate 170 may be an FR4 (Flame Retardant 4) substrate, a PCB (Printed Circuit Board), or an FPC (Flexible Printed Circuit). Specifically, the dielectric substrate 170 has a first surface E1 and a second surface E2 which are opposite to each other. The ground element 110, the first radiation element 120, and the second radiation element 130 may all be disposed on the first surface E1 of the dielectric substrate 170. In some embodiments, the first radiation element 120 substantially extends along the periphery of the first surface E1 of the dielectric substrate 170.

In a preferred embodiment, a planar antenna structure of the mobile device 100 is formed by the first radiation element 120 and the second radiation element 130, and it has the advantages of a simple manufacturing process and low complexity.

Figure 2:
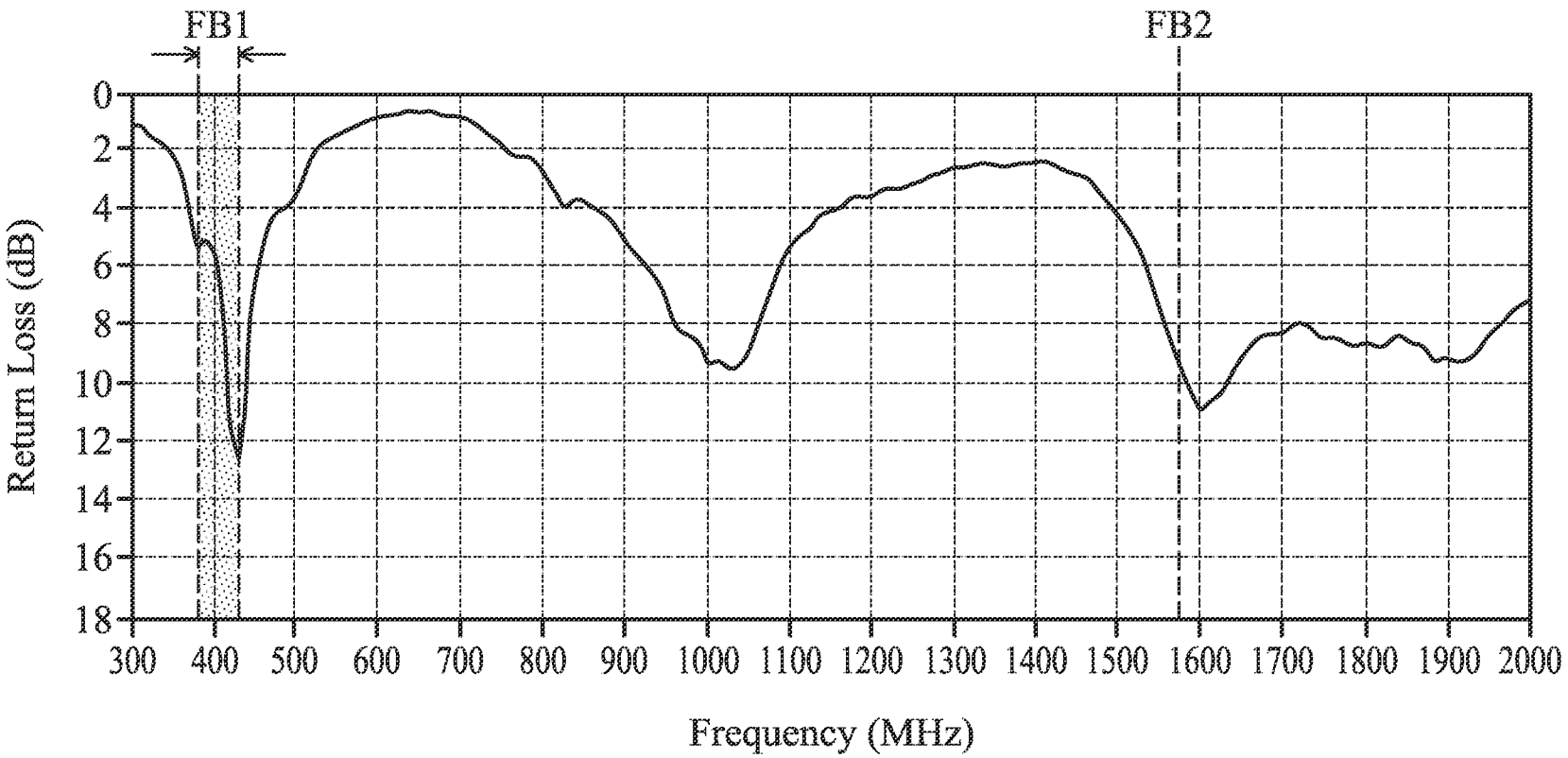
FIG. 2 is a diagram of return loss of a planar antenna structure of a mobile device according to an embodiment of the invention.

FIG. 2 is a diagram of return loss of the planar antenna structure of the mobile device 100 according to an embodiment of the invention. The horizontal axis represents operational frequency (MHz), and the vertical axis represents return loss (dB). According to the measurement of FIG. 2, the planar antenna structure of the mobile device 100 can cover a TETRA (Terrestrial Trunked Radio) frequency band FB1 and a GPS (Global Positioning System) frequency band FB2. The TETRA frequency band FB1 may be from 380 MHz to 430 MHz, for example, and the GPS frequency band FB2 may be around 1575 MHz, but they are not limited thereto. Therefore, the planar antenna structure of the mobile device 100 can at least support the wideband operations of both TETRA and GPS.

With respect to the antenna theory, the first radiation element 120 is excited to generate the TETRA frequency band FB1. In addition, the second radiation element 130 is excited to generate the GPS frequency band FB2. According to practical measurements, the whole size of the planar antenna structure of the mobile device 100 can be further minimized after the meandering portion 124 of the first radiation element 120 is used and the coupling gap GC1 between the first radiation element 120 and the second radiation element 130 is applied. For example, the length L1 of the first radiation element 120 may be shorter than 0.25 wavelength ($\lambda/4$) of the TETRA frequency band FB1, and the length L3 of the second radiation element 130 may be shorter than 0.25 wavelength ($\lambda/4$) of the GPS frequency band FB2.

Figure 3:
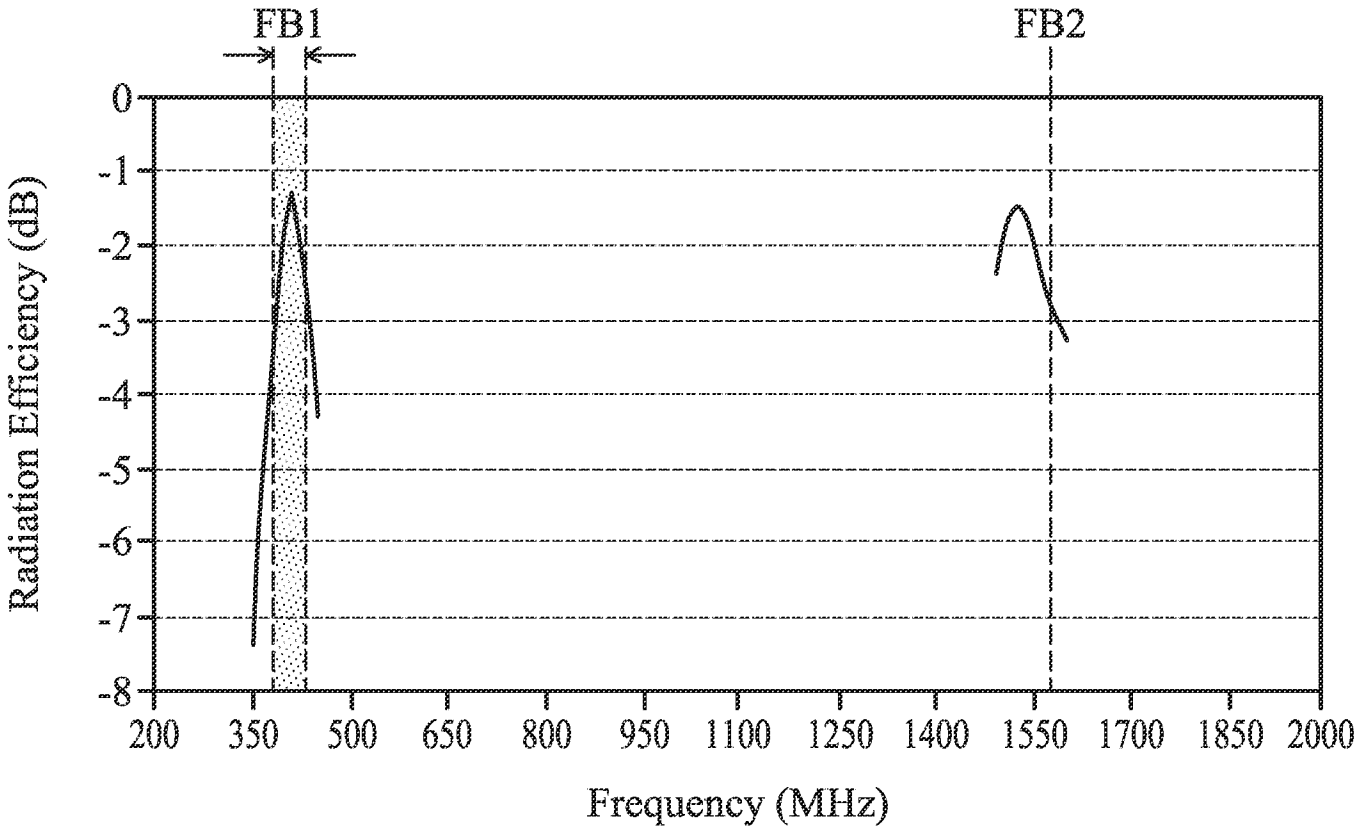
FIG. 3 is a diagram of radiation efficiency of a planar antenna structure of a mobile device according to an embodiment of the invention.

FIG. 3 is a diagram of radiation efficiency of the planar antenna structure of the mobile device 100 according to an embodiment of the invention. The horizontal axis represents the operational frequency (MHz), and the vertical axis represents the radiation efficiency (dB). According to the measurement of FIG. 3, the radiation efficiency of the planar antenna structure of the mobile device 100 can reach at least −4 dB within the TETRA frequency band FB1 and the GPS frequency band FB2, and it can meet the requirements of practical application of general mobile communication devices.

In some embodiments, the element sizes of the mobile device 100 will be described as follows. The length L1 of the first radiation element 120 may be substantially equal to 0.22 wavelength ($0.22\lambda$) of the TETRA frequency band FB1. The width W1 of the first radiation element 120 may be from 1 mm to 2 mm. The length L2 of the meandering portion 124 of the first radiation element 120 may be from 0.04 to 0.05 wavelength ($0.04\lambda$~$0.05\lambda$) of the TETRA frequency band FB1. The length L3 of the second radiation element 130 may be substantially equal to 0.15 wavelength ($0.15\lambda$) of the GPS frequency band FB2. In the second radiation element 130, the width W2 of the narrow portion 134 may be from 1 mm to 2 mm, and the width W3 of the wide portion 135 may be from 3 mm to 4 mm. The width of the coupling gap GC1 may be from 3 mm to 4 mm. In the first radiation element 120, the width W4 of the first notch 127 may be from 2 mm to 4 mm, and the width W5 of the second notch 128 may also be from 2 mm to 4 mm. The above ranges of element sizes are calculated and obtained according to many experimental results, and they can help to optimize the radiation efficiency, the operational bandwidth, and the impedance matching of the planar antenna structure of the mobile device 100.

The invention proposes a novel mobile device and a novel antenna structure therein. In comparison to the conventional design, the invention has at least the advantages of planarization, small size, wide bandwidth, and low manufacturing cost, and therefore it is suitable for application in a variety of mobile communication devices or IOT.

Note that the above element sizes, element shapes, and frequency ranges are not limitations of the invention. An antenna designer can fine-tune these settings or values according to different requirements. It should be understood that the mobile device of the invention is not limited to the configurations of FIGS. 1-3. The invention may merely include any one or more features of any one or more embodiments of FIGS. 1-3. In other words, not all of the features displayed in the figures should be implemented in the mobile device of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A mobile device, comprising:

a ground element;

a first radiation element, having a feeding point, wherein the first radiation element comprises a meandering portion and a terminal extension portion;

a second radiation element, coupled to the feeding point, wherein the second radiation element is at least partially surrounded by the first radiation element, wherein the second radiation element comprises a narrow portion and a wide portion, and the wide portion is coupled through the narrow portion to the feeding point, and wherein a coupling gap is formed between the first radiation element and the second radiation element; and a dielectric substrate, wherein the ground element, the first radiation element, and the second radiation element are disposed on the dielectric substrate;

wherein a planar antenna structure is formed by the first radiation element and the second radiation element;

wherein the planar antenna structure covers a first frequency band defined as a TETRA (Terrestrial Trunked Radio) frequency band and a second frequency band defined as a GPS (Global Positioning System) frequency band.

2. The mobile device as claimed in claim 1, further comprising:

a signal source, wherein the signal source has a positive electrode coupled to the feeding point, and a negative electrode coupled to a grounding point on the ground element.

3. The mobile device as claimed in claim 1, wherein the TETRA frequency band is from 380 MHz to 430 MHz.

4. The mobile device as claimed in claim 1, wherein the GPS frequency band is around 1575 MHz.

5. The mobile device as claimed in claim 1, wherein the first radiation element substantially has an inverted U-shape.

6. The mobile device as claimed in claim 1, wherein the meandering portion of the first radiation element substantially has an inverted M-shape.

7. The mobile device as claimed in claim 1, wherein the second radiation element substantially has a variable-width straight-line shape.

8. The mobile device as claimed in claim 1, wherein the coupling gap is formed between the terminal extension portion of the first radiation element and the wide portion of the second radiation element.

9. The mobile device as claimed in claim 1, wherein a width of the narrow portion of the second radiation element is from 1 mm to 2 mm.

10. The mobile device as claimed in claim 1, wherein a width of the wide portion of the second radiation element is from 3 mm to 4 mm.

11. The mobile device as claimed in claim 1, wherein a length of the first radiation element is shorter than 0.25 wavelength of the TETRA frequency band.

12. The mobile device as claimed in claim 1, wherein a length of the first radiation element is substantially equal to 0.22 wavelength of the TETRA frequency band.

13. The mobile device as claimed in claim 1, wherein a length of the meandering portion of the first radiation element is from 0.04 to 0.05 wavelength of the TETRA frequency band.

14. The mobile device as claimed in claim 1, wherein a length of the second radiation element is shorter than 0.25 wavelength of the GPS frequency band.

15. The mobile device as claimed in claim 1, wherein a length of the second radiation element is substantially equal to 0.15 wavelength of the GPS frequency band.

16. The mobile device as claimed in claim 1, wherein a width of the coupling gap is from 3 mm to 4 mm.

17. The mobile device as claimed in claim 1, wherein the meandering portion of the first radiation element defines a first notch and a second notch.

18. The mobile device as claimed in claim 17, wherein a width of each of the first notch and the second notch is from 2 mm to 4 mm.

* * * * *